United States Patent [19]

Fiedziuszko

[11] Patent Number: 4,489,293

[45] Date of Patent: Dec. 18, 1984

[54] MINIATURE DUAL-MODE, DIELECTRIC-LOADED CAVITY FILTER

[75] Inventor: Slawomir J. Fiedziuszko, Palo Alto, Calif.

[73] Assignee: Ford Aerospace & Communications Corporation, Detroit, Mich.

[21] Appl. No.: 466,180

[22] Filed: Feb. 14, 1983

Related U.S. Application Data

[63] Continuation of Ser. No. 262,580, May 11, 1981, abandoned.

[51] Int. Cl.[3] ..... H01P 1/207; H01P 1/208; H01P 7/06; H01P 7/10

[52] U.S. Cl. ..... 333/202; 333/209; 333/212; 333/229; 333/231

[58] Field of Search ..... 333/202, 206-212, 333/219, 222-224, 227-231, 234-236, 246, 248, 21 A, 21 R

[56] References Cited

U.S. PATENT DOCUMENTS

| | | | |
|---|---|---|---|
| 3,697,898 | 10/1972 | Blachier et al. | 333/209 |
| 3,969,692 | 7/1976 | Williams et al. | 333/212 |
| 4,019,161 | 4/1977 | Kimura et al. | 333/234 |
| 4,027,256 | 5/1977 | Dixon | 333/17 L |
| 4,028,652 | 6/1977 | Wakino et al. | 333/209 |
| 4,060,779 | 11/1977 | Atia et al. | 333/212 |
| 4,142,164 | 2/1979 | Nishikawa et al. | 333/227 |
| 4,143,344 | 3/1979 | Nishikawa et al. | 333/202 |
| 4,184,130 | 1/1980 | Nishikawa et al. | 333/202 X |
| 4,241,322 | 12/1980 | Johnson et al. | 333/209 |

OTHER PUBLICATIONS

Yoshio Kobayashi et al., "Resonant Modes of a Dielectric Rod Resonator Short-Circuited at Both Ends by Parallel Conducting Plates", 8099 IEEE Transactions on Microwave Theory and Techniques, vol. MTT-28; No. 10, Oct. 1980, New York, USA.

J. K. Plourde et al., "Microwave Dielectric Resonator Filters Utilizing $Ba_2Ti_9O_{20}$ Ceramics", 1977, IEEE MTT-S International Microwave Symposium Digest.

P. Guillon et al., "Dielectric Resonator Dual Modes Filter", 8030 Electronics Letters, vol. 16, (1980), Aug., No. 17, Hitchin Herts.

G. Pfitzenmaier, "A Waveguide Multiplexer with Dual-Mode Filters for Satellite Use", 5th European Microwave Conference, Sep. 1-4, 1975, Hamburg, Germany.

Mahieu, "Low Conversion Losses Up and Down Converters, Using Dielectric Resonators for Application with Millimetric Telecommunication Systems", 6th European Microwave Conference, Sep. 14-17, 1976, Rome, Italy.

Deschamps et al., "Les Filtres Elliptiques à Cavités Hyperfréquences dan les Satellites", L'Onde Electrique, 1980, vol. 60, No. 2.

*Primary Examiner*—Marvin L. Nussbaum

*Attorney, Agent, or Firm*—Edward J. Radlo; Robert D. Sanborn; Robert K. Stoddard

[57] ABSTRACT

A ceramic resonator element having high Q, high dielectric constant, and a low temperature coefficient of resonant frequency is enclosed within a cavity to form a composite microwave resonator having reduced dimensions and weight as compared to a simple cavity resonator. A pair of tuning screws extend into the cavity along orthogonal axes to tune the structure to resonance along these axes at frequencies near the fundamental resonance of the ceramic element. Several such cavities can be formed in a short length of waveguide by the use of transverse partitions at spaced intervals and coupling between cavities can be accomplished by using simple slot, cross or circular irises. In each cavity, a mode-perturbing screw is positioned along an axis 45° from each of the orthogonal tuning screws, such that resonance along either of the orthogonal axes is coupled to excite resonance also along the other. The realization of complex filter functions requiring cross couplings is feasible by means of coupling separately to only one of the two orthogonal resonant modes in the cavities.

14 Claims, 4 Drawing Figures

MINIATURE DUAL-MODE, DIELECTRIC-LOADED CAVITY FILTER

This is a continuation of application Ser. No. 262,580, filed May 11, 1981, now abandoned.

BACKGROUND OF THE INVENTION

I. Field of the Invention

The apparatus of this invention is a microwave filter having particular application in transmitters and receivers designed to meet difficult requirements of minimum size, minimum weight and tolerance of extreme environmental conditions. Filters according to the teachings of the present invention are thus suited to use in mobile, airborne, or satellite communication systems in which the requirement exists to sharply define a number of relatively narrow frequency bands or channels within a relatively broader portion of the frequency spectrum. Thus, filters designed according to the present invention are especially useful in bandpass configurations which define the many adjacent channels utilized in satellite communication stations for both military and civilian purposes.

Such satellite communication stations have come to be used for a variety of purposes such as meteorological data gathering, ground surveillance, various kinds of telecommmunication, and the retransmission of commercial television entertainment programs. Since the cost of placing a satellite in orbit is considerable, each satellite must serve as many communication purposes and cover as many frequency channels as possible. Consequently, the ability to realize complex and sophisticated filter functions in compact and lightweight filter units is a significant advance which permits the extension of frequency band coverage without an increase in size or weight. Moreover, these advances are possible without relaxing the stringent requirements which must be met by such communication systems, including the requirement to maintain stable performance over a wide range of temperature.

II. Description of the Prior Art

U.S. Pat. No. 3,205,460 issued Sept. 7, 1965 to E. W. Seeley et al and covers a microwave filter formed of rectangular waveguide dimensioned to be below cutoff at the frequencies for which the filter is designed. However, a rectangular slab of dielectric extends from top to bottom of the waveguide at spaced intervals along the midplane line of the waveguide, such that a series of spaced susceptances is produced. Tuning screws were used to permit fine tuning of the filter. However, this patent contains no information concerning how to realize filter functions more complex than the simple iterative bandpass design which has been illustrated. In particular, there are no teachings as to how to employ dual mode operation, or as to ways to realize cross-couplings for filter designs which require them.

U.S. Pat. No. 3,475,642 issued Oct. 28, 1969 to A. Karp et at, and covers a slow-wave structure in which a series of spaced discs of rutile ceramic extend along a waveguide. The patent contains no teachings of the advantages of using dual mode operation, and employs single mode operation in the $TE_{01\delta}$ mode.

U.S. Pat. No. 3,496,498 issued Feb. 17, 1970 to T. Kawahashi et al, and covers a microwave filter in which a series of metal rods, each being dimensioned to be a quarter wavelength long at the frequencies of interest, is spaced along a waveguide structure to form the filter. The rods may be grooved to vary their electrical length without changing their physical length.

U.S. Pat. No. 4,019,161 issued Apr. 19, 1977 to Kimura et at., covering a temperature-compensated dielectric resonator device utilizing single-mode operation in the $TE_{01\delta}$ mode.

U.S. Pat. No. 4,027,256 issued May 31, 1977 to Samuel Dixon, and covers a type of wide-band ferrite limiter in which a ferrite rod extends axially along the center of a cylindrical dielectric structure and through the centers of a plurality of dielectric resonator discs which are spaced along the resonant structure. The patent contains little of interest to the worker seeking to realize microwave filter functions in compact high performance filter units.

U.S. Pat. No. 4,028,652 issued June 7, 1977 to Wakino et al., and covers a single-mode filter design in which a variety of differently shaped and dimensioned ceramic resonant elements are disclosed and described. The patent does not, however, suggest the use of dual-mode operation of any of the resonant structures.

U.S. Pat. No. 4,142,164 issued Feb. 27, 1979 to Nishikawa et al., and covers a dielectric resonator utilizing the $TE_{01\delta}$ mode. The patent is primarily intended to cover the technique of fine tuning by the application of selected amounts of a synthetic resin which bonds to the ceramic resonator elements to incrementally alter their resonant frequencies. There is no suggestion to use dual-mode operation.

U.S. Pat. No. 4,143,344 issued Mar. 6, 1979 to Nishikawa et al., covering a microwave resonant structure which utilizes two modes in its operation. However, the modes utilized, using the nomenclature of this reference, are the $H_{01\delta}$ and $E_{11\delta}$, modes which have very dissimilar field distributions. At least partly as a consequence of this fact, the reference contains no teachings as to how to control coupling to each of the modes, and therefore does not show how to realize one pole of a filter function with each of the modes. As a result, there would be no way within the teachings of this patent to realize a complex 6-pole response in a filter having only 3 resonators, as could be done if coupling to each of the modes could be independently controlled.

U.S. Pat. No. 4,184,130 issued Jan. 15, 1980 to Nishikawa et al., and covers a filter design employing a single mode ($TE_{01\delta}$) in a resonator which is coupled to a coaxial line by means of a short section of that line which has been made leaky by cutting apertures in the outer conductor.

U.S. Pat. No. 4,197,514 issued Apr. 8, 1980 to Kasuga et al., covering a microwave delay equalizer. There is no suggestion as to how to make miniature high performance filters which can realize complex filter functions.

In addition to the above prior art which utilizes solid, high dielectric constant resonant elements, there is a considerable body of generally earlier prior art in which unfilled cavity resonators of a variety of configurations were employed, sometimes with dual-mode operation. However, due to the unity dielectric constant of the resonant space, the resultant structures were relatively bulky.

Among this body of prior art relating to unfilled cavity resonators may be mentioned:

U.S. Pat. No. 3,697,898 to Blachier et al.

U.S. Pat. No. 3,969,692 to Williams et al.

U.S. Pat. No. 4,060,779 to Atia et al.

British Pat. No. 1 133 801 to G. Craven.

The Williams et al. patent discusses dual mode filters utilizing the conventional cavity resonators, while the British patent utilizes evanescent modes. However, none of this prior art relating to unfilled cavity resonators contains any suggestion to significantly reduce the volume of the resonant structure by employing resonator element of high dielectric constant as the principal component of the resonator, while enclosing this element within a reduced-dimension cavity which would itself be below cutoff at the frequencies of interest were it not for the included resonator element.

SUMMARY OF THE INVENTION

The principal object of the present invention is the provision of a microwave filter having reduced dimensions and weight as compared to prior art filters of comparable performance.

A second object of the present invention is the provision of a microwave filter which can readily realize complex filter functions involving several or many poles, or cross-couplings between poles.

A third object of the present invention is the provision of a resonator element having high dielectric constant and low temperature coefficient of resonant frequency, and a cavity resonator surrounding and electrically enclosing said resonator element to form a composite resonator.

A fourth object of the present invention is the provision of a plurality of such composite resonators, together with microwave coupling means therebetween to form a filter capable of realizing a variety of complex filter functions within a compact and lightweight unit.

A fifth object of the present invention is the provision in such a composite resonator of means to cause simultaneous resonance in each of two orthogonal resonant modes.

A sixth object of the present invention is the provision of means to separately tune such a composite resonator for each of the orthogonal modes.

A seventh object of the present invention is the provision of means to perturb the fields in each resonator such that resonance excited along a first axis is coupled to also excite resonance along a second orthogonal axis.

The above and other objects of the present invention are achieved by the realization of filter functions in the form of compact filter units which utilize composite resonators operating simultaneously in each of two orthogonal resonant modes. Each of these orthogonal resonant modes is tunable independently of the other, such that each can be used to realize a separate pole of a filter function.

The composite resonators themselves comprise resonator elements made of a high dielectric constant $\epsilon$ solid material and may comprise short cylindrical sections of a ceramic material, together with a surrounding cavity resonator which is dimensioned small enough in comparison to the wavelengths involved that it would be well below cutoff but for the high dielectric constant resonator element within the cavity.

Capacitive probes or inductive irises may be used to provide coupling between several such composite resonators, and also to provide input and output coupling for the entire filter unit formed of these composite resonators. By suitably positioning these coupling devices with respect to the two orthogonal resonant modes, it is possible to achieve cross-coupling between any desired resonant modes, such that filter functions requiring such couplings can easily be realized.

Independent tuning of the orthogonal resonant modes is achieved by the use of a pair of tuning screws projecting inwardly from the cavity wall along axes which are orthogonal to one another. Microwave resonance along either of these axes is coupled to excite resonance along the other by a mode coupling screw projecting into the cavity along an axis which is at 45° to the orthogonal mode axes.

Excellent temperature stability is achieved by choosing a resonator material having a temperature coefficient of resonant frequency which is nearly zero, and by selecting materials for the resonant cavity and the tuning screws such that thermal expansion of one is very nearly compensated by thermal expansion of the other.

BRIEF DESCRIPTION OF THE DRAWINGS

The above and other detailed and specific objects, features, and advantages of the present invention will become clearer from a consideration of the following detailed description of a preferred embodiment, and a perusal of the associated drawings, in which.

DETAILED DESCRIPTION OF A PREFERRED EMBODIMENT

Figure 1:
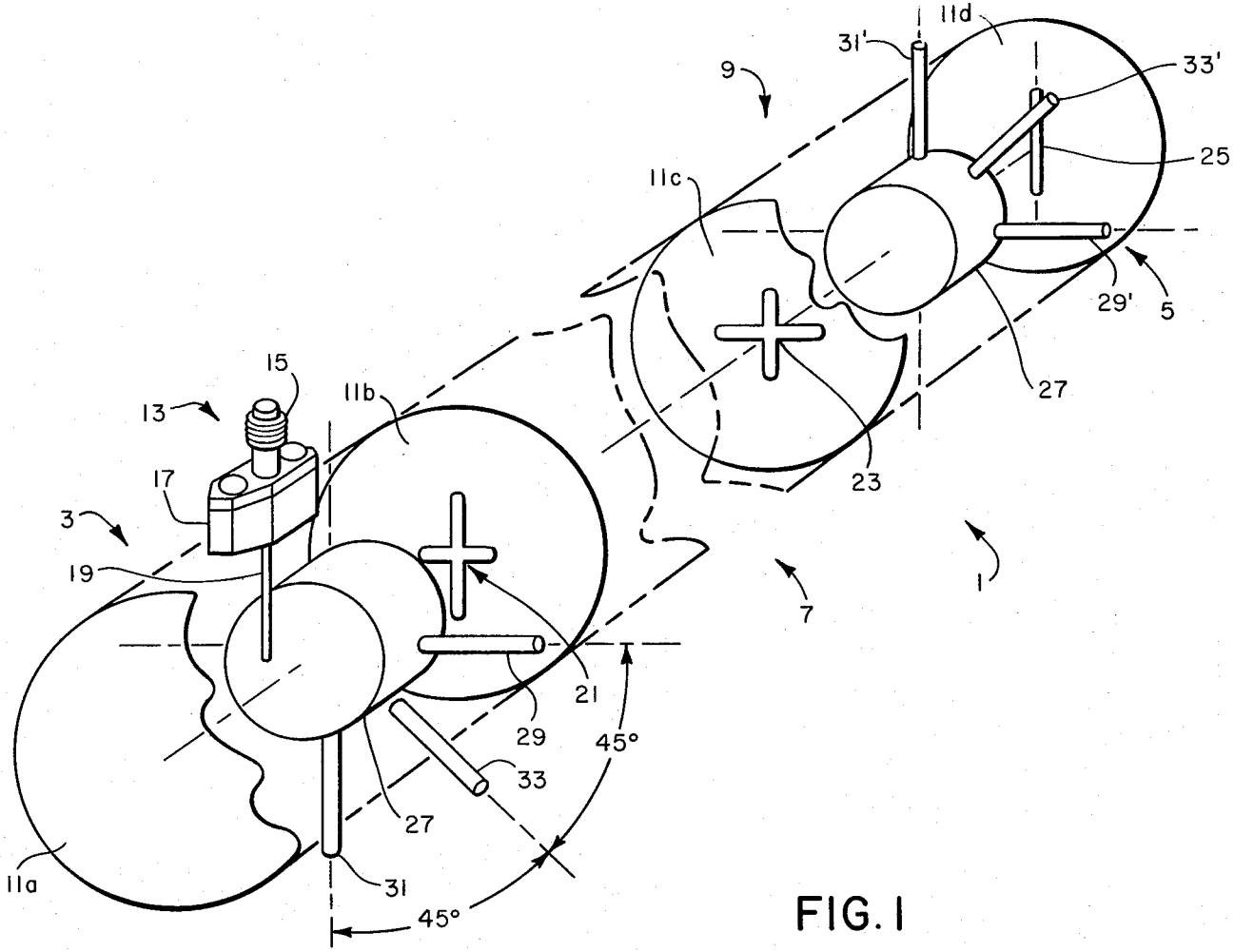
FIG. 1 is a phantom perspective view illustrating an elliptic-function multiple-cavity filter embodying the features of the present invention.

In FIG. 1, a multi-cavity filter 1 embodying features of the present invention is shown. Filter 1 is shown to comprise an input cavity 3, an output cavity 5, and one or more intermediate cavities 7, which are indicated more-or-less schematically in the broken region between cavities 3 and 5. Cavities 3, 5, and 7 may all be electrically defined within a short length of cylindrical waveguide 9 by a series of spaced, transversely extending cavity endwalls 11*a, b, c,* and *d*. These endwalls and waveguide 9 may be made of invar or graphite-fiber-reinforced plastic (GFRP) or of any other known material from which waveguide hardware is commonly made. Furthermore, waveguide 9 and endwalls 11*a–d* may be surface plated with a highly conductive material such as silver, which may be applied by being sputtered onto the surfaces thereof. Endwalls 11*a–d* may be joined to the interior wall of waveguide 9 by any known brazing or soldering technique, or by other known bonding techniques as appropriate to the materials concerned.

An input coupling device in the form of a probe assembly 13 is used to couple microwave energy from an external source (not shown) into input cavity 3. As shown in FIG. 1, probe assembly 13 includes a coaxial input connector 15, an insulative mounting block 17, and a capacitive probe 19. Microwave energy coupled to probe 19 is radiated therefrom into input cavity 3, where microwave resonance is excited in the hybrid $HE_{111}$ mode. From input cavity 3, microwave energy is further coupled into intermediate cavities 7 by a first iris 21 of cruciform shape, and from intermediate cavities 7 into output cavity 5 by second iris 23, also of cruciform shape. Finally, energy is coupled from output cavity 5 into a waveguide system (not shown) by an output iris 25 of simple slot configuration.

Within each of cavities 3, 5, and 7 is disposed a dielectric resonator element 27 made of a material possessing a high dielectric constant, a high Q, and a low temperature coefficient of resonant frequency. Resonant element 27 is cylindrical in form as shown, such that together with cylindrical cavities 3, 5, and 7, composite resonators of axially symmetric shape are formed. Resonator elements 27 may be made of a variety of materials such as rutile, barium tetratitanate ($BaTi_4O_9$), related ceramic compounds such as the $Ba_2Ti_9O_{20}$ compound which was developed by Bell Laboratories, or a series of barium zirconate ceramic compounds which are available from Murata Mfg. Co. under the tradename Resomics.

The best of such materials form ceramic resonator elements possessing the desirable combination of high dielectric constant (>35), high Q (≧7500), and a low temperature coefficient of resonant frequency (<15 for barium tetratitanate and as low as 0.5 for Resomics, in ppm/°C.). With careful design and choice of materials for cavities 3, 5, and 7, the composite resonators formed by the combination of cavity and resonator element can also possess a high Q and a low temperature coefficient of resonant frequency, while the high dielectric constant of the resonator element concentrates the electromagnetic field of resonant energy within the dielectric element, thus significantly reducing the physical size of the composite resonator as compared to "empty" cavity resonators designed for the same resonant frequency.

Although, as noted above, each cylindrical resonator element together with the cylindrical cavity in which it is disposed, forms a composite resonator having axial symmetry, each of these composite resonators is provided with means to tune it to resonance along each of a pair of orthogonal axes. Thus, in FIG. 1 a first tuning screw 29 projects into input cavity 3 along a first axis which intersects the axis of cavity 3 and resonator element 27 at substantially a 90° angle thereto. A second tuning screw 31 similarly projects into cavity 3 along a second axis which is rotationally displaced from the first axis by 90°. Tuning screws 29 and 31 serve to tune cavity 3 to resonance in each of two orthogonal $HE_{111}$ resonant modes along the first and second axes respectively. Since the amount of projection of screws 29 and 31 is independently adjustable, each of the two orthogonal modes can be separately tuned to a precisely selected resonant frequency, such that input cavity 3 can provide a realization of two of the poles of a complex filter function.

In order to provide a variable amount of coupling between the two orthogonal resonant modes in cavity 3, a third tuning screw or mode coupling screw 33 is provided extending into cavity 3 along a third axis which is substantially midway between the first two axes or at an angle of 45° thereto. Screw 33 serves to perturb the electromagnetic field of resonant energy within the cavity such that resonance along either the first or second axis is coupled to excite resonance along the other as well. Moreover, the degree of such coupling is variable by varying the amount by which screw 33 projects into cavity 3.

As noted above, waveguide 9 may be formed of a variety of known materials. One particularly satisfactory material is thin (0.3 to 1.0 mm) Invar, which can be used to form the cavity resonators and endwalls 11*a–d*. The low temperature coefficient of expansion (≃1.6 ppm/°C.) and fine machinability of this material contribute to the stability and performance of the finished filter. When Invar is used for the waveguide and endwalls, brazing may be carried out using a "NiOro" brazing alloy consisting of 18% nickel and 82% gold. Similarly, the material used to form the three screws 29, 31, and 33 can be selected in consideration of the temperature coefficient of resonant frequency of resonator element 27 and the temperature coefficient of expansion of the material used for construction of the cavities so that the temperature coefficient of resonant frequency of the composite resonator is as near zero as possible. When Invar is used for the cavity structure, in combination with a resonator element having a coefficient of 0.5 ppm/°C., brass or Invar can be successfully used as materials for the tuning and mode coupling screws. With different choices of material for the cavities, or a different temperature coefficient of resonant frequency of the resonator element, other materials such as aluminum may be found useful in securing a near-zero temperature coefficient for the composite resonator.

Although not shown in FIG. 1, resonator elements 27 can be successfully mounted in cavities 3, 5, and 7 by a variety of insulative mounting means which generally take the form of pads or short columns of low-loss insulator material such as polystyrene or PTFE. However, the best performance has been obtained by the use of mountings made of a low-loss polystyrene foam.

Each of cavities 3, 5, and 7 is similarly equipped with first and second tuning screws extending along orthogonal axes and a mode coupling screw extending along a third axis which is at substantially a 45° angle to the first and second axes. These screws have not been shown for the imtermediate cavity 7, while they have been illustrated as 29′, 31′, and 33′ for output cavity 5, where the primed numbers correspond to like-numbered parts in cavity 3. Further, although screws 29′, 31′, and 33′ have been illustrated in an alternative orientation with respect to the central axis of the cavities, it is to be understood that their function is not altered thereby, and the orthogonal first and second axes remain in the same position as in the case of input cavity 3.

Similarly, each cavity is equipped with means to couple microwave energy into and out of the cavity. With the exception of probe assembly 13 in input cavity 3, these means all comprise one or another variety of iris in the embodiment of FIG. 1. However, the coupling means could be entirely capacitive probes, or inductive irises, or any combination of the two. Further, although irises 21 and 23 have been illustrated as cruciform in shape, such that they function as orthogonal slot irises to couple to each of the two orthogonal modes in the respective cavities, other forms of iris could be used, depending on the nature of the intercavity coupling required by the filter function being realized.

Figure 2:
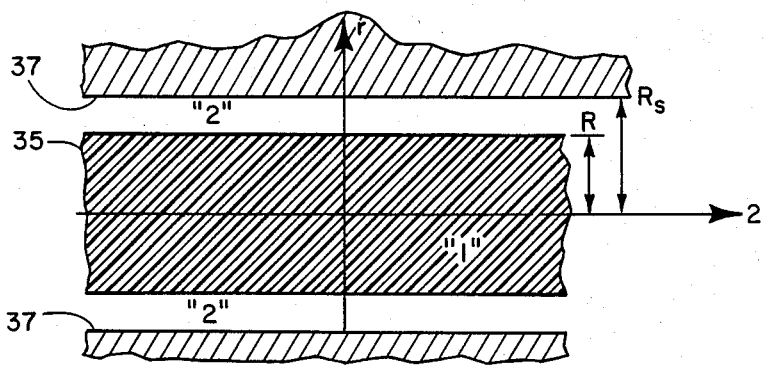
FIG. 2 is a cross-sectional view, partly schematic in form, illustrating a theoretical model useful in calculating resonant frequencies of the filter sections in accordance with the present invention.

In FIG. 2 is shown a simple theoretical model useful in calculating the resonant frequency of each composite resonator, such that it is possible to accurately design each of the composite resonators needed to realize a complex filter function. In FIG. 2, the composite resonator is modeled as a dielectric cylinder 35 having a radius R and being made of a material having a dielectric constant $\epsilon$, coaxially surrounded by a cylindrical conductive wall 37 representing the inner surface of a circular waveguide of radius $R_s$. In the development which follows, the dielectric-filled region in FIG. 2, marked "1" in the drawing, will be denoted by the subscript 1 following the respective parameters. Similarly, the region marked "2" in the drawing between radius R and radius $R_s$ will be assumed to be evacuated and to have a dielectric constant equivalent to free-space permittivity $\epsilon_0$. When referring to this region, the subscript 2 will be used.

Using the approach developed by A. D. Yaghjian and E. T. Kornhauser in "A Modal Analysis of the Dielectric Rod Antenna Excited by the $HE_{111}$ Mode", *IEEE Trans. on Antennas and Propagation,* Vol. AP-20, No. 2, March 1972, the longitudinal components of the electromagnetic field in regions "1" and "2" can be expressed in the form:

$$E_{z1}=A(K_R I_a - I_R K_a)J_1(hr)\cos\theta e^{-j\gamma_i Z}$$

and $$H_{z1}=B(K_R' I_a - I_R' K_a)J_1(hr)\sin\theta e^{-j\gamma_i Z}$$

in region "1", and $$E_{z2}=A[K_R I_1(pr) - I_R K_1(pr)]J_1(hr)\cos\theta e^{-j\gamma_i Z}$$

and $$H_{z2}=B[K_R' I_1(pr) - I_R' K_1(pr)]J_1(hr)\sin\theta e^{-j\gamma_i Z}$$

in region "2", where

R = Radius of the dielectric cylinder 35

$R_s$ = Radius of the conductive wall 37

$\gamma_i$ = Propagation constant in Z-direction $\lambda_0$ = Free-space wavelength corresponding to the resonant frequency $f_0$ $J_1$ = Bessel function of first kind, first order $K_n$ = Modified Hankel function of n-th order $I_n$ = Modified Bessel function All the differentiation is in respect to the argument of the function.

$I_a = I_1(pR)$ $I_k = I_1(pR_s)$ $K_a = K_1(pR)$ $K_R = K_1(pR_s)$

By considering that the angular (tangential) components of magnetic and electric field must be continuous at the interface between regions "1" and "2" (i.e., at radius R), and introducing for simplicity the relations:

$$A_1 = K_R I_a - I_R K_a$$

$$A_2 = K_R' I_a' - I_R' K_a'$$

$$B_1 = K_R' I_a - I_R' K_a$$

$$B_2 = K_R I_a' - I_R K_a'$$

$$J = J_1(hR)$$

we can obtain the following transcendental equation:

$$\left(\frac{\epsilon}{p}A_1 J' + \frac{B_2 J}{h}\right)\left(\frac{J' B_1}{p} + \frac{A_2 J}{h}\right) - \left(\frac{\gamma_i^2}{\omega^2\mu_0\epsilon_0 R^2}A_1 B_1 J^2\right)\left(\frac{1}{p^2}+\frac{1}{h^2}\right)^2 = 0 \quad [1]$$

Assuming that dielectric cylinder 35 is either short circuited by an electric wall or open circuited by a magnetic wall: $\gamma_i L = \pi$, and $\gamma_i = \pi/L$. From this relation and equation [1] immediately above, the resonant frequencies of the $HE_{111}$ mode can be calculated. In these calculations, L is the actual length of the resonator element, while $\mu_0$ is free-space permeability. The p and h parameters in equation [1] are defined as follows:

$$h^2 = \epsilon(2\pi/\lambda_0)^2 - \gamma_i^2$$

and $$p^2 = \gamma_i^2 - (2\pi/\lambda_0)^2.$$

Calculations of resonant frequency based on equation [1] above have proven to be sufficiently accurate to be useful. Their agreement with measured resonant frequencies is reasonably good so long as the ratio of diameter to length of the resonator element is less than about 3. However, it was felt that a still closer agreement between predicted and measured results was desirable.

Figure 3:
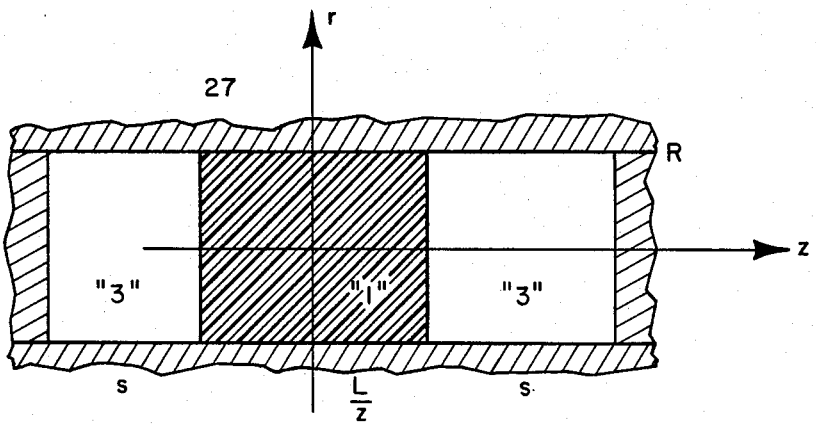
FIG. 3 is a cross-sectional view, partly schematic in form, illustrating a theoretical model useful in calculating axial electromagnetic field distribution in the filter cavities of the present invention.

In FIG. 3, a second theoretical model useful in analyzing the axial distribution of electromagnetic field for the purpose of refining the calculations of resonant frequency is illustrated. A detailed analysis of the resonances of such a structure has been published by E. O. Amman and R. J. Morris in the paper "Tunable Dielectric-Loaded Microwave Cavities Capable of High Q and High Filling Factor", *IEEE Trans.* MTT-11, pp. 528–542, November 1963.

Briefly stated, it is possible to analyze the $HE_{111}$ resonance of this structure by separation of this hybrid mode into its linear TE and TM mode-components. In FIG. 3, the region occupied by resonator element 27' has been labeled region "1" as before, while the region beyond the ends of dielectric has been labeled region "3". Using Maxwell's equations to analyze the field within these regions, and matching tangential components of the field at $z = \pm L/2$, it is possible to derive the transcendental equation:

$$\gamma_i \tan \gamma_i L/2 - \gamma_0 \operatorname{cotan} h\gamma_0 s = 0 \quad [2]$$

Equation [2] applies for the TE EVEN mode, for which $E_z = 0$, and $H_z$ is symmetrical about the plane $z = 0$. The parameters in equation [2] are defined as follows:

$$\gamma_i^2 = (2\pi/\lambda_0)^2\epsilon - (2\pi/\lambda_c)^2$$

$$\gamma_0^2 = (2\pi/\lambda_c)^2 - (2\pi/\lambda_0)^2$$

$\lambda_c$ = cut-off wavelength for the particular waveguide mode, as determined by geometry and mode order.

s = distance from transverse metal wall 37.

It can be shown that equations [1] and [2] form a set of coupled equations from which the values of $f_0$ and $\gamma_i$ can be determined, thus providing values of the resonant frequencies. To verify the validity of the resonator model, data was measured for several samples of high-$\epsilon$, low-loss resonators. This data, showing especially a high degree of correlation between theoretically predicted and measured resonant frequency, is presented below:

| Resonator material | Dielectric constant $\epsilon$ | Resonator radius, inch | Resonator length, inch | Freq. theor. MHz | Freq. meas. MHz |
|---|---|---|---|---|---|
| Resomics C | 37.6 | .394 | .315 | 3576 | 3368 |
| Resomics C | 37.6 | .316 | .273 | 4181 | 4196 |
| Resomics E | 38.2 | .267 | .222 | 4789 | 4994 |

-continued

| Resonator material | Dielectric constant $\epsilon$ | Resonator radius, inch | Resonator length, inch | Freq. theor. MHz | Freq. meas. MHz |
|---|---|---|---|---|---|
| Resomics C | 37.6 | .200 | .180 | 6116 | 6255 |
| Resomics C | 37.6 | .212 | .182 | 5844 | 6182 |
| Barium Tetratitanate | 37.25 | .336 | .215 | 4115 | 4225 |

The correlation between theoretically predicted and experimentally measured resonant frequencies for these samples, all of which had values of $\epsilon$ near 38, and for frequencies in the range of 3–6 GHz, is thus within 5%.

Figure 4:
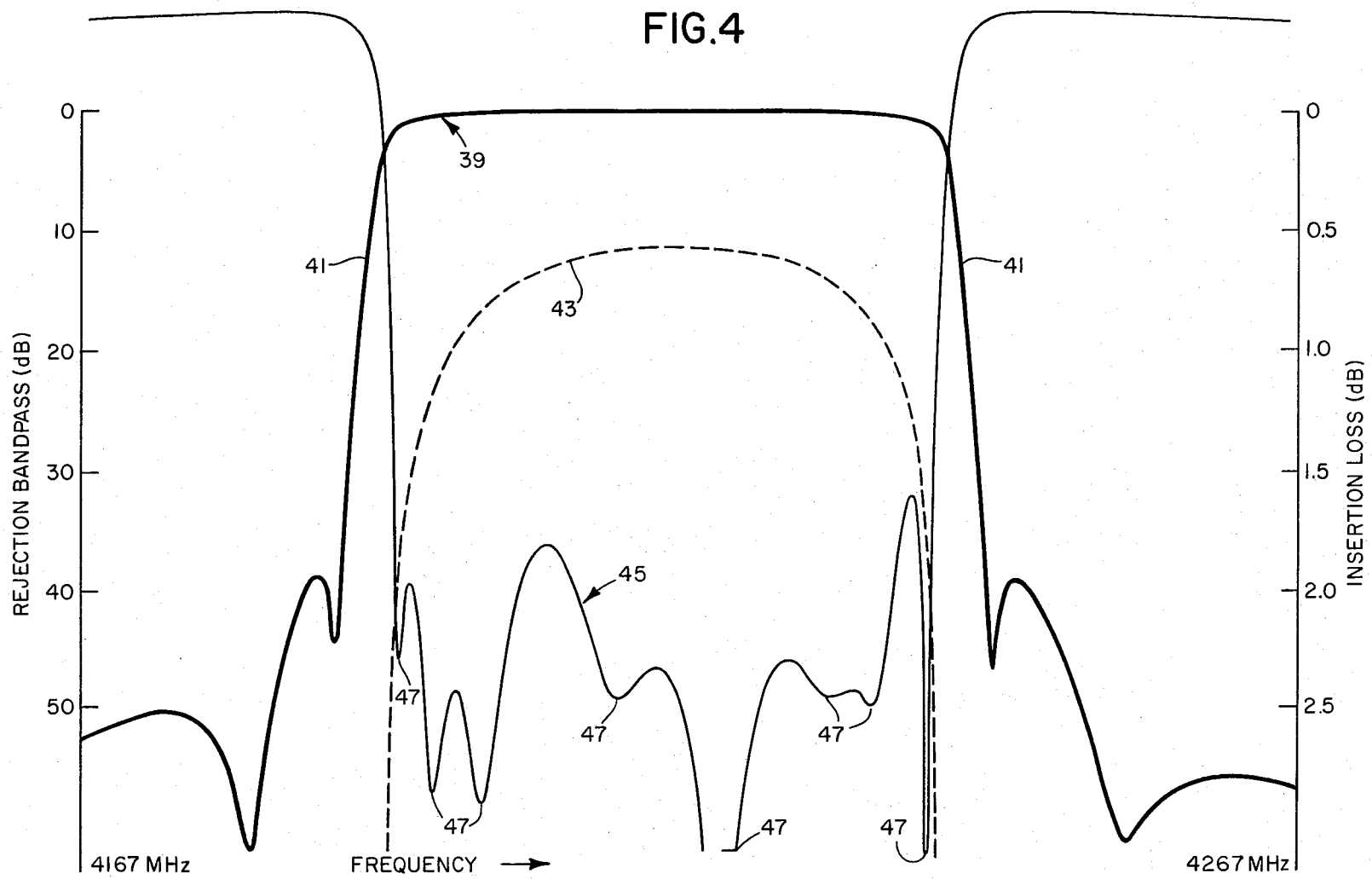
FIG. 4 is a graphical representation of the passband performance of an 8-pole quasi-elliptic filter function when realized according to the teachings of the present invention.

Turning to FIG. 4, the actual passband performance of an 8-pole, quasi-elliptic bandpass filter built according to the teachings of the present invention is illustrated. FIG. 4 is actually representative of the performance of a filter constructed in accordance with the embodiment of FIG. 1 of this application, using a total of only four cavities, (such that intermediate cavities 7 are two in number).

A rejection curve 39 in FIG. 4 shows the frequency response of the filter on a highly magnified frequency scale which is centered on the narrow passband region at approximately 4.2 GHz. As curve 39 illustrates, the passband of this filter is bounded by steep skirts 41, providing almost an ideal bandpass characteristic.

An insertion loss curve 43 in FIG. 4 shows the passband region of curve 39 on a 20-times magnified amplitude scale to reveal the insertion loss of the filter within the passband region. As curve 43 illustrates, the insertion loss for this filter is less than 1.0 dB over most of the passband, again indicating a very high level of performance.

Finally, FIG. 4 shows reflected power in the form of a return loss curve 45, which is similar to a curve of VSWR for the filter, except that the amplitude is plotted on a logarithmic (dB) scale. Curve 45 reveals quite clearly the presence and frequency-spacing of the 8 poles of this filter by means of eight corresponding peaks 47 on the trace of curve 45. Curve 45 thus serves as a check of the accuracy of the realization of the filter function upon which this filter was based.

The performance revealed by the curves of FIG. 4 is indicative of a very high-Q, low loss design. In the past such performance has been achieved only by the use of low-loss unfilled cavity resonators in this frequency range. While the electrical performance of such resonators was thus entirely satisfactory, their physical size and weight prevented their utilization in many applications, and exacted too heavy a toll in others when they were used. However, the use of composite resonators employing a high-Q, high-$\epsilon$ resonator element operating in a cavity resonator of considerably reduced size in accordance with the teachings of the present invention can be expected to permit the realization of high performance filters in units so compact and lightweight as to make their use in the most demanding applications a reality.

Although the invention of this application has been described with some particularity by reference to a set of preferred embodiments which comprise the best mode contemplated by the inventor for carrying out his invention, it will be obvious to those skilled in the art that many changes could be made and many apparently different embodiments thus derived without departing from the scope of the invention. For example, although the invention has been disclosed in an embodiment which utilizes cylindrical resonator elements disposed in cylindrical cavity resonators, the invention is not limited to this geometry. In fact, other axially symmetric configurations such as a square cross-section normal to the composite resonator axis could be used for either the dielectric resonator element or the cavity resonator or for both. Similarly, although fabrication technology and thermal problems at present have been quite successfully solved by the use of thin-wall Invar cavity structures, it is anticipated that other materials may seem more advantageous in the future as their fabrication technologies and temperature-compensation problems are more fully developed and resolved. Consequently, it is intended that the scope of the invention be interpreted only from the following claims.

What is claimed is:

1. A miniaturized microwave filter comprising in combination:

a first composite microwave resonator comprising a cavity resonator and, disposed within said cavity resonator, a dielectric resonator element made of a material having a high dielectric constant $\epsilon$ and a high Q, said resonator element having a self-resonant frequency, the dimensions of said cavity resonator being selected so as to cause said composite resonator to have a first order resonance at a frequency near said self-resonant frequency;

first tuning means to tune said composite resonator to resonance at a first frequency along a first axis;

second tuning means to tune said composite resonator to resonance at a second frequency along a second axis orthogonal to said first axis;

mode coupling means to cause mutual coupling between resonant energy on said first and second axes to thereby cause resonant energy on either of said axes to couple to and excite resonant energy on the other of said axes;

input means to couple microwave energy into said cavity resonator; and output means to couple a portion of said resonant energy on one of said axes out of said cavity resonator.

2. The filter of claim 1 wherein said cavity resonator is a cylindrical cavity, and wherein said first and second axes intersect the axis of said cylindrical cavity, and said resonator element is disposed generally on said cavity axis.

3. The filter of claim 1 wherein said resonances on said first and second axes are resonances in the $HE_{111}$ mode.

4. The filter of claim 2 wherein said resonator element is cylindrical and is disposed with its axis generally collinear with said cavity axis.

5. The filter of claim 1 wherein said resonator element is made of a material selected from the class consisting of rutile, barium tetratitanate ($BaTi_4O_9$), $Ba_2Ti_9O_{20}$ and barium zirconate compounds.

6. The filter of claim 1 wherein said resonator element is selected to have a temperature coefficient $\leqq 1$ ppm/°C., and wherein said cavity resonator is made of Invar.

7. The filter of claim 1 wherein said first tuning means is adjustable to selectably vary the frequency of resonance along said first axis.

8. The filter of claim 7 wherein said first tuning means comprises an adjustable susceptance extending along said first axis from a wall of said cavity resonator toward said resonator element.

9. The filter of claim 8 wherein said adjustable susceptance comprises a tuning screw extending through said wall of said cavity resonator.

10. The filter of claim 1 wherein said mode coupling means comprises an adjustable susceptance disposed along a third axis generally equi-angularly spaced from said first and second axes.

11. The filter of claim 10 wherein said mode coupling means comprises a mode coupling screw extending through a wall of said cavity resonator toward said resonator element along said third axis, and wherein said third axis is angularly spaced from each of said first and second axes by substantially 45°.

12. The filter of claim 6 wherein said first and second tuning means and said mode coupling means comprise independently adjustable susceptances made of a material selected to compensate for temperature variations in the resonant frequency of said composite resonator, and to thereby maintain a temperature coefficient of resonant frequency of said composite resonator of $<1$ ppm/°C.

13. The filter of claim 12 wherein said material is selected from the class consisting of brass, Invar, and Aluminum.

14. A microwave filter comprising, in combination:

a first resonator having a first cavity and, disposed within said cavity, a first dielectric made of a material having a high dielectric constant and a high Q, said first dielectric having a first self-resonant frequency, the dimensions of said first cavity being selected so that said first resonator has a first order resonance at a frequency near said first self-resonant frequency;

a second resonator having a second cavity and, disposed within said cavity, a second dielectric made of a material having a high dielectric constant and a high Q, said second dielectric having a second self-resonant frequency, the dimensions of said second cavity being selected so that said second resonator has a first order resonance at a frequency near said second self-resonant frequency;

first tuning means in said first resonator for tuning said first resonator to resonance at a first frequency along a first axis;

second tuning means in said first resonator for tuning said first resonator to resonance at a second frequency along a second axis orthogonal to said first axis;

third tuning means in said second resonator for tuning said second resonator to resonance at a third frequency along a third axis;

fourth tuning means in said second resonator for tuning said second resonator to resonance at a fourth frequency along a fourth axis orthogonal to said third axis;

first mode coupling means in said first resonator for causing mutual coupling between resonant energy along said first and second axes;

second mode coupling means in said second resonator for causing mutual coupling between resonant energy along said third and fourth axes;

input means in said first resonator for coupling microwave energy into said first resonator;

said first and second resonators sharing a common wall, and, defined within said wall, an iris means for coupling resonant energy along one of said first and second axes from said first to said second resonator; and output means in said second resonator for coupling microwave energy out of said second resonator.

* * * * *